US006122784A

United States Patent [19]

Hurwitz

[11] Patent Number: 6,122,784

[45] Date of Patent: Sep. 26, 2000

[54] TRAVEL HEADREST

[76] Inventor: Stanley Hurwitz, 8511 Bairdmore Crescent, Richmond, British Columbia, Canada, V7C 1M8

[21] Appl. No.: 09/290,861

[22] Filed: Apr. 14, 1999

[51] Int. Cl.[7] ..... A47C 20/02

[52] U.S. Cl. ..... 5/636; 5/637; 5/644; D6/601

[58] Field of Search ..... 5/636, 637, 644, 5/640, 655.3, 655.9; D6/596, 601, 604

[56] References Cited

U.S. PATENT DOCUMENTS

| | | | |
|---|---|---|---|
| D. 360,554 | 7/1995 | Righini | D6/604 |
| 682,871 | 9/1901 | Hogan et al. | 5/644 |
| 2,336,707 | 12/1943 | Thompson | 5/636 |
| 3,050,748 | 8/1962 | Deutinger | 5/644 |
| 4,031,578 | 6/1977 | Sweeney et al. | 5/636 |
| 4,236,264 | 12/1980 | Britzman | 5/435 |
| 4,550,458 | 11/1985 | Fiore | 5/637 |
| 4,738,488 | 4/1988 | Camelio | 5/636 |
| 5,129,705 | 7/1992 | Wray | 5/636 |
| 5,205,611 | 4/1993 | Stephens | 297/391 |
| 5,503,456 | 4/1996 | Rossini | 297/397 |
| 5,682,632 | 11/1997 | Cotroneo | 5/636 |

*Primary Examiner*—Lynne H. Browne
*Assistant Examiner*—James M Hewitt

[57] ABSTRACT

A travel headrest, having first and second head cushions each having a top portion, a bottom portion and opposite sides and being elongate from the top portion to the bottom portion. The second head cushion portion includes an intermediate portion between its top and bottom portions and a flexible connecting portion interconnects the first head cushion and the intermediate portion, the top and bottom portions of the second head cushion projecting upwardly and downwardly, respectively, from the intermediate portion and from the connecting portion. The cushions may be stuffed or inflatable.

4 Claims, 5 Drawing Sheets

TRAVEL HEADREST

BACKGROUND OF THE INVENTION

1. Field of the Invention

The present invention relates to a travel headrest and more particularly to a travel headrest intended to be used by a person sitting in a high-backed seat, for example an aircraft seat.

2. Description of the Related Art

The need for a headrest for supporting the head of a user while the user is seated in a high-backed seat and is in a relaxed, dozy or even sleeping condition has been previously recognized and various head supports have been proposed for this purpose.

For example, U.S. Pat. No. 4,236,264, issued Dec. 2, 1980 to Agnita Britzman, discloses a horseshoe-shaped pillow support having spaced-apart legs projecting forwardly from a horseshoe return, the pillow support being inflatable by air so that, on inflation, three extremities of the legs swing inwardly towards one another to be in contact with one another. In use, this pillow support is arranged around the neck of a user and rests on the user's shoulders. This prior pillow support is particularly useful when worn around the neck of a sunbather, in which case the pillow support may be employed for elevating the sunbathers head to a desired inclination or for reading or for otherwise observing the surrounding scenery while the sunbather is lying on his back. However, if used in a high-backed seat, this prior pillow support has the disadvantage that since, it will rest on the user's shoulders, it will support only a very limited area of the side of the user's face and head.

In U.S. Pat. No. 5,205,611 issued Apr. 27, 1993 to Frederick O. Stevens, there is disclosed a head support pillow having a base portion against which the user rests his or her head and a lateral support portion which supports the user's head to resist rotation of the user's head about the axis of the user's neck. This lateral support portion, in use, rests on the user's shoulder and against the back of a seat, and extends upwardly from the user's shoulder over a portion of the height of the user's head, which rests against the base portion. A second embodiment shown on this prior patent has two spaced lateral support portions on opposite side of the base portion. While the lateral support portions are recessed for partly accommodating the user's head and thereby resisting relative movement between the pillow and the user's head, the or each lateral support portion is connected along its entire height to the base portion, which extends behind the user's head and consequently will be restrained by the base portion from being tucked beneath the user's chin.

BRIEF SUMMARY OF THE INVENTION

It is accordingly an object of the present invention to provide a novel and improved headrest which is capable of supporting a user's head along at least a major portion of the height of the head while, at the same time, fitting under and supporting a user's chin and cheek and, also, being retained by a portion of the head support nestled against an opposite side of the user's head.

According to the present invention, there is provided a travel headrest which has first and second cushions, each having a top portion, a bottom portion and opposite sides, the second cushion also having an intermediate portion between the top and bottom portions and the first and second cushion portions being elongate from the top portions to the bottom portions thereof. A flexible connecting portion interconnects the first cushion to the intermediate portion of the second cushion whereby the top and bottom portions of the second cushion project upwardly and downwardly, respectively, from the intermediate portion.

When this total headrest is in use, the user rests his or her face against the second cushion portion, and the bottom portion of the second cushion can then fit snugly beneath the user's cheek and chin, while the top portion supports the uppermost region of the user's head. One side of the user's head is, in this way, snugly supported by the second cushion. Meanwhile, the first cushion rests on the user's shoulder, and against the user's head, at the opposite side of the user's head, and thereby serves to anchor the headrest in position relative to the user's head.

When required, the present travel headrest can be reversed on the user to support the other side of the user's head.

BRIEF DESCRIPTION OF THE DRAWINGS

The invention will be more readily understood from the following description thereof given, by way of example, with reference to the accompanying drawings, in which.

DESCRIPTION OF THE PREFERRED EMBODIMENTS

Figure 1:
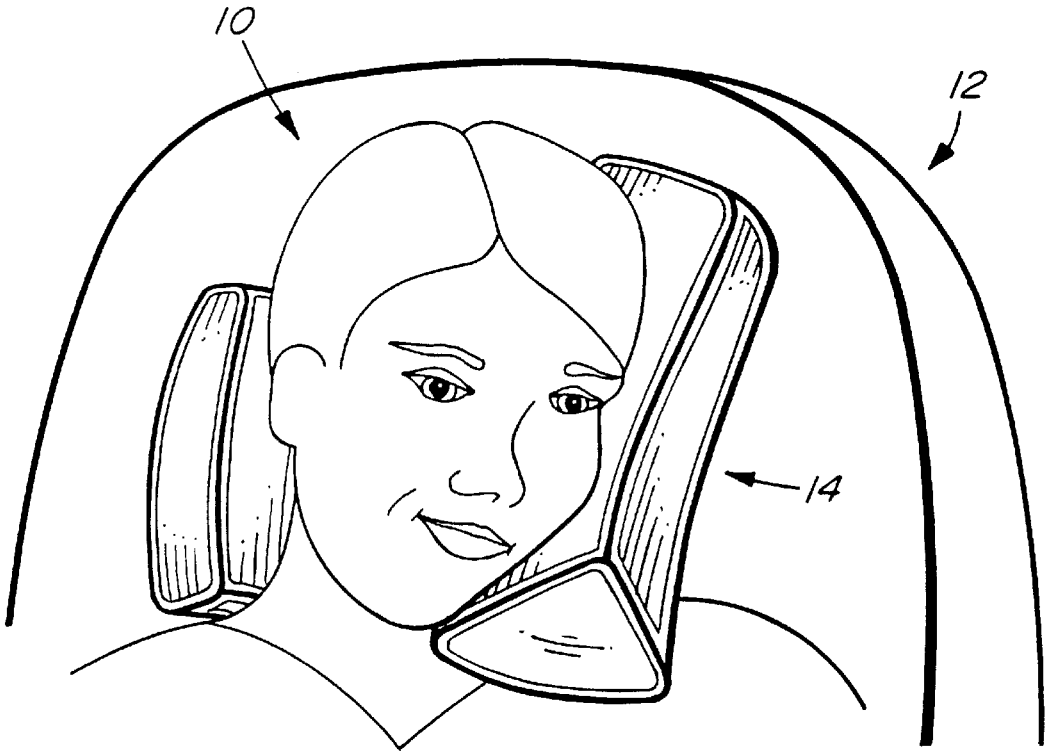
FIG. 1 shows a broken-away view of a seated person using a travel headrest according to a first embodiment of the present invention.

FIG. 1 shows a person, indicated generally by reference numeral 10, seated in a seat indicated generally by reference numeral 12, which may for example be an aircraft seat, with the user's head supported on a travel headrest indicated generally by reference numeral 14.

Figure 2:
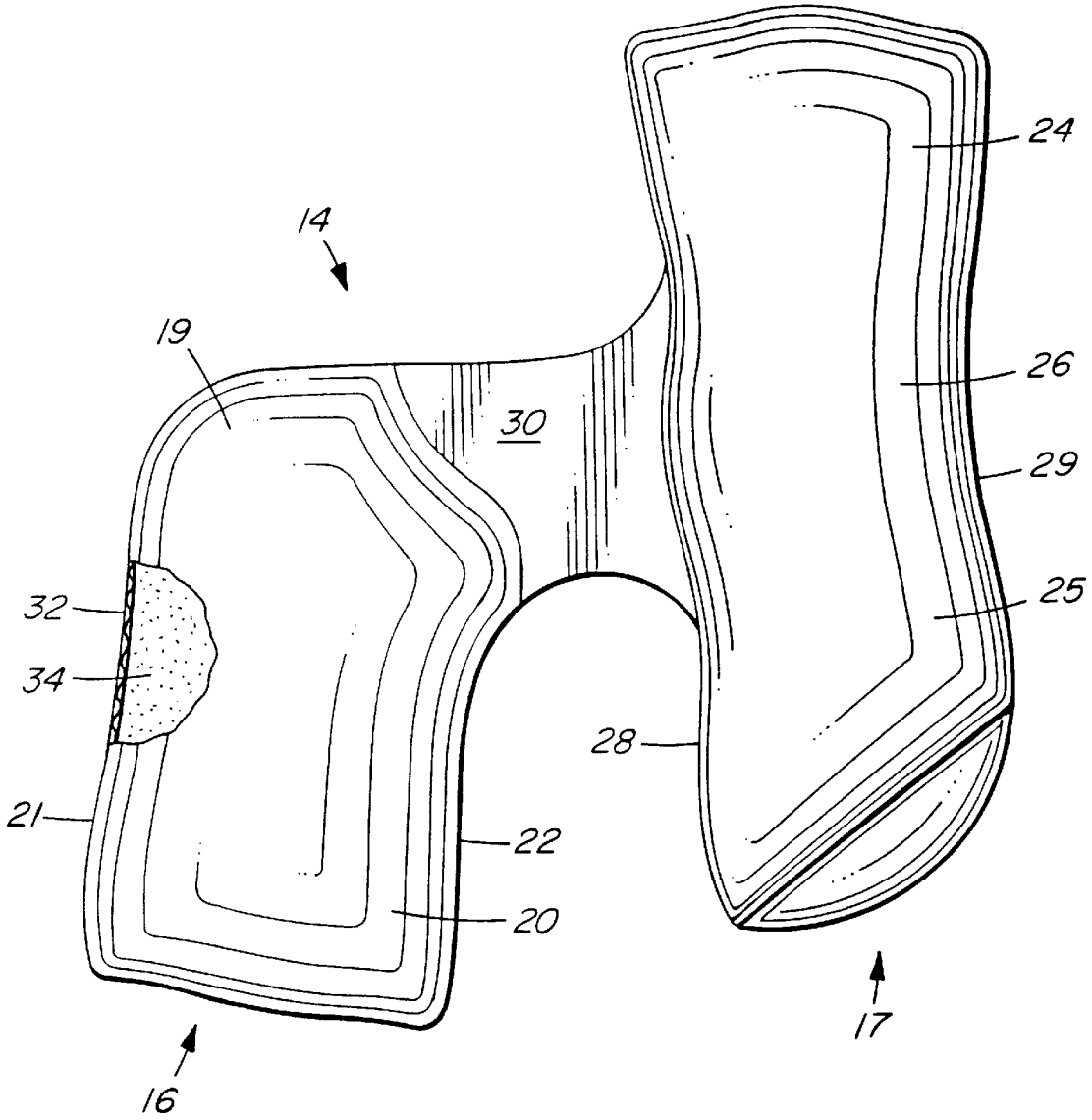
FIG. 2 shows a view in front elevation of the travel headrest of FIG. 1.

As shown in FIG. 2, the travel headrest 14 comprises a first head cushion and a second head cushion, indicated generally by reference numerals 16 and 17, respectively.

The first head cushion 16 has a top portion 19, a bottom portion 20 and opposite sides 21 and 22 and is elongate from the top portion 19 to the bottom portion 20.

The second head cushion 17 has a top portion 24, a bottom portion 25, an intermediate portion 26 between the top and bottom portions 24 and 25, and opposite sides 28 and 29, and is elongate from the top portion 24 to the bottom portion 25.

The two cushions 16 and 17 are interconnected by a connecting portion 30 which, in the present embodiment of the invention, comprises a web of fabric material.

More particularly, the travel headrest 14 comprises a covering 32 of fabric material, which is stitched together to form two closed pockets and these pockets each contain a stuffing material 34 to thereby form the two cushions 16 and 17. The fabric covering 32 also forms the web connecting portion 30, which comprises two layers or sheets of the fabric stitched together but containing no stuffing material between them.

Figure 3:
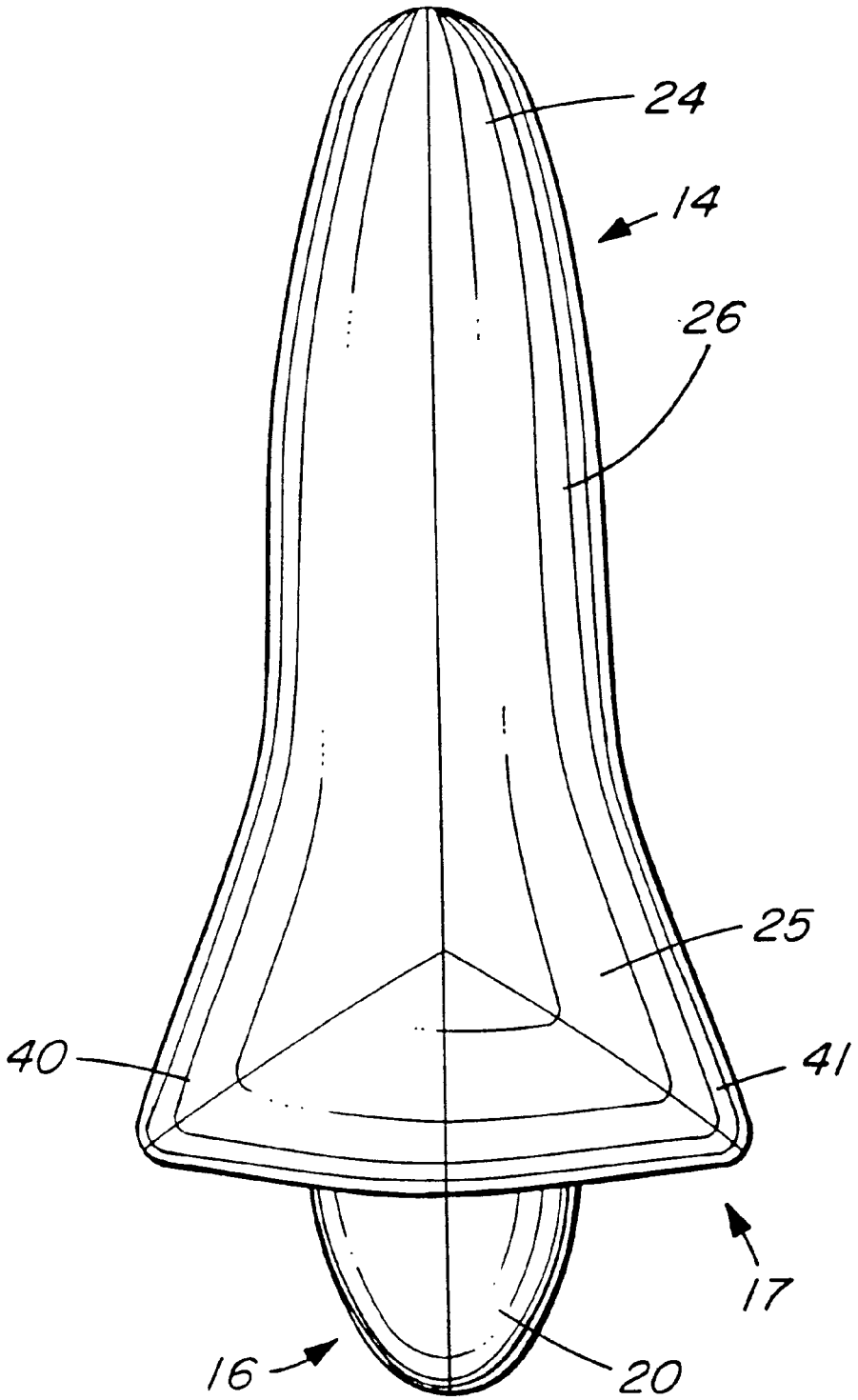
FIG. 3 shows a view in side elevation of the travel headrest of FIGS. 1 and 2.
Figure 4:
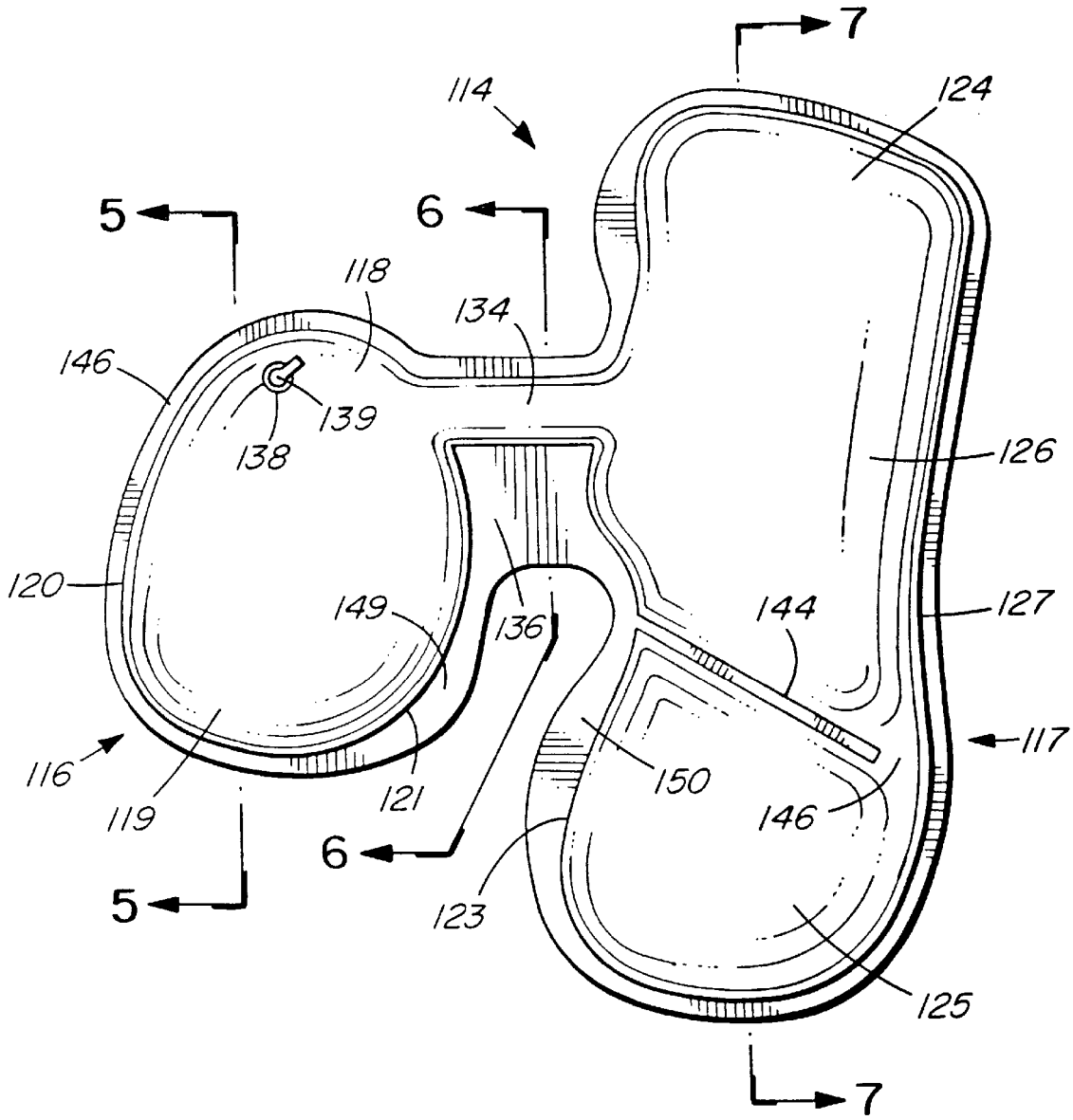
FIG. 4 shows a view in front elevation of a second embodiment of the travel headrest according to the present invention.
Figure 5:
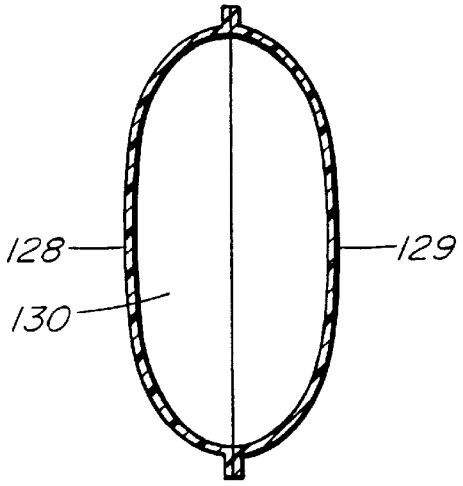
FIGS. 5, 6 and 7 show views taken in cross-section along the lines 5—5, 6—6 and 7—7, respectively, of FIG. 3.
Figure 6:
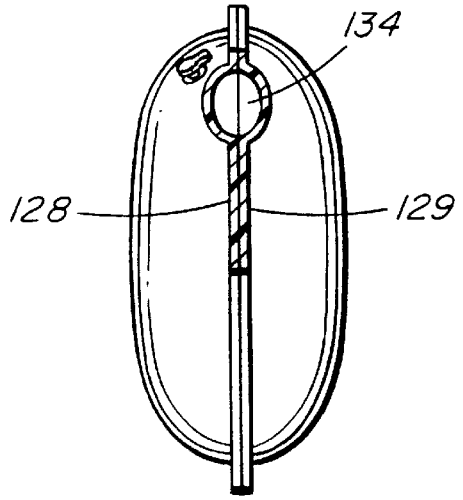
Figure 7:
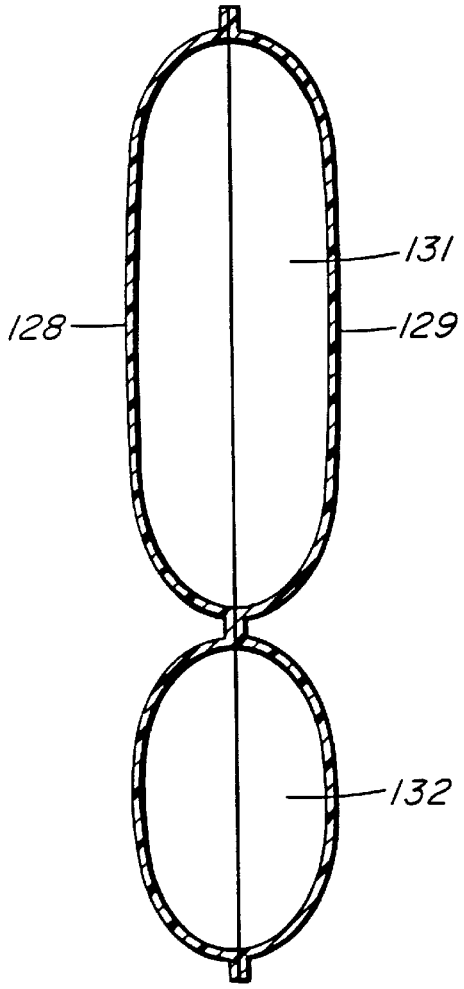

As can be seen from FIG. 2, the connecting portion 30 extends from the top portion 19 of the first cushion 16 to the intermediate portion 26 of the second cushion 17. This connecting portion 30 is readily flexible, so that the first and second cushion 17 can be readily reoriented relative to one another. As can be seen in FIG. 3, which shows a view in elevation taken from the right-hand side of FIG. 2, the bottom portion of the second portion is formed with bulges 40 and 41 which project forwardly and rearwardly, respectively of the headrest support 14.

The entire travel headrest 14 may be provided with a removable cover (not shown) for obvious hygienic and aesthetic reasons.

Referring again to FIG. 1, it will be seen that, as illustrated in this figure, the second cushion 17 forms a support for the entirety of one side of the user's head. More particularly, the bottom portion 25 with the forward bulge 40 tuck under and support the user's chin and cheek, while the top portion 24 projects upwardly, beyond the connecting portion 30, to support the top of the user's head. The connecting portion 30 extends around the back of the user's head, in the space between the base of the skull and the top of the neck, so that the travel headrest 14 is thereby restrained from inadvertently displaced upwardly relative to the user's head, which is stabilized and supported by the headrest 14.

At the opposite side of the user's head, the first cushion 16 rests on or above the user's shoulder and against the opposite side of the user's head and neck and serves as an anchor for restraining the travel headrest 14 against lateral displacement relative to the user's head.

Referring now to FIGS. 4 through 7 of the accompanying drawings, there is shown a travel headrest indicated generally by reference numeral 114 forming a second embodiment of the present invention.

The travel headrest 114 comprises air cushions indicated generally by reference numerals 116 and 117. The air cushion 116 forms a first head cushion which has a top portion 118, a bottom portion 119 and opposite sides 120 and 121 and is somewhat elongate from the top portion 118 to the bottom portion 119 thereof.

The air cushion 117 forms a second head cushion which has a top portion 124, a bottom portion 125, an intermediate portion 126 between the top and bottom portions 124 and 125, and opposite sides 123 and 127

As can readily be seen from FIGS. 4 to 7, the travel headrest 114 is formed by sheets 128 and 129 of plastic material which are welded togther around the peripheries of the air cushions 116 and 117 to define air chambers 130 and 131.

The air chamber 130 communicates with the air chamber 131 through an air passage 134 which extends through a connecting portion 136 of the travel headrest 114. The air cushion 116 is provided with an air inlet 138 provided with a valve 139, by means of which the two air cushions 116 and 117 may be inflated by opening the valve 139 and blowing in through the air inlet 138.

The air chambers 131 and 132, which are upper and lower air chambers, respectively, of the second air cushion 117, are separated from one another by a weld line 144, along which the plastic sheets 128 and 129 are welded together. The weld line 144 forms a fold line between the upper and lower chambers 131 and 132, allowing the lower chamber 132 and thus the lower portion 125 of the air cushion 117, to be swung to and fro, and thus flexed about the weld line 144, to enable the lower portion 125 to be tucked under the user's chin. The weld line 144 is interrupted by an opening 146, through which the air chambers 131 and 132 communicate with one another. Also, it will be seen that the weld line 144 is inclined downwardly from the side 123 of the air cushion, to further facilitate snugness between the second air cushion 117 and one side of the user's face.

The welding together of the plastic sheets 128 and 129 forms a peripheral flange or web 146 extending around the entire periphery of the travel headrest 114, and this web 146 is of enlarged width at the connecting portion 148. Also, the web 146 has a portion 149 of enlarged width at the side 121 of the first air cushion 116 and a portion 150 of enlarged width at the facing side 123 of the air cushion 117, and these enlarged portions 149 and 150 of the web 146 are folded, in use, so as to avoid discomfort between the peripheral web 146 and the user's face.

The plastic sheets 128 and 129 are preferably formed of a plastic material which, at least on the outer side of the travel headrest 114, has a fabric-like surface to promote comfortable support of the user's head. As in the previous embodiment, the travel headrest 114 may be provided with a removable fabric covering (not shown).

When the headrest 114 is in use, the inflated air passage 134 fits between the user's head and the top of the user's neck to stabilize the head and the headrest, and the pressure exerted by the user against the air passage 134 pinches the air passage 134 and thereby restricts or even entirely interrupts communication of the air cushions 116 and 117. Also, when the lower portion 125 of the air cushion 117 is swung forwards about the weld line 144 to nestle beneath the user's chin, the opening 146 is thereby also pinched and partly or even entirely closed, so that the bottom portion 125 remains inflated and supports the user.

As will be apparent to those skilled in the art, various modifications may be made in the above-described invention within the scope of the appended claims.

What is claimed is:

1. A travel headrest, comprising:

a first head cushion;

said first head cushion having a top portion, a bottom portion and opposite sides and being elongate from said top portion to said bottom portion thereof;

a second head cushion;

said second head cushion having a top portion, a bottom portion, an intermediate portion between said top and bottom portions and opposite sides and being elongate from said top portion to said bottom portion thereof; and a flexible connecting portion interconnecting said top portion of first head cushion to said intermediate portion of said second head cushion;

said bottom portion of said first cushion projecting downwardly beyond said connecting portion;

said top and bottom portions of said second cushion projecting upwardly and downwardly, respectively, beyond said intermediate portion and beyond said connecting portion;

said first and second head cushions comprising a pair of inflatable air cushions;

said second head cushion comprising upper and lower air chambers, a fold line between said upper and lower air chambers, said fold line facilitating flexing of said upper and lower air chambers relative to one another about said fold line, and an air opening through which said upper and lower air chambers communicate with one another; and said upper air chamber forming said top and intermediate portions of said second head cushion and said lower air chamber forming said bottom portion of said second head cushion.

2. A travel headrest as claimed in claim 1, wherein said upper and lower air chambers have walls defining said upper and lower air chambers, said fold line comprising a weld line at which said walls are connected to one another, said weld line separating said upper and lower air chambers from one another and said opening being formed by an interruption in said weld line.

3. A travel headrest as claimed in claim 1, including an air passage extending through said connecting portion and communicating with said air cushions, and an air inlet in one of said air cushions, said air inlet having a valve for closing said air inlet.

4. A travel headrest as claimed in claim 1, wherein said connecting portion comprises a web extending between said first and second head cushions.

* * * * *